US006801724B2

(12) United States Patent
Matsumoto et al.

(10) Patent No.: US 6,801,724 B2
(45) Date of Patent: Oct. 5, 2004

(54) IMAGE FORMING APPARATUS

(75) Inventors: Hideki Matsumoto, Shizuoka (JP); Norihito Naito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/408,576

(22) Filed: Apr. 8, 2003

(65) Prior Publication Data

US 2003/0219265 A1 Nov. 27, 2003

(30) Foreign Application Priority Data

Apr. 9, 2002 (JP) ..... 2002-106686

(51) Int. Cl.[7] ..... G03G 15/00

(52) U.S. Cl. ..... 399/38; 399/50; 399/53; 399/55

(58) Field of Search ..... 399/38, 50, 53, 399/55

(56) References Cited

U.S. PATENT DOCUMENTS 5,146,281 A * 9/1992 Kisu ..... 399/174
5,227,842 A * 7/1993 Hayashi et al. ..... 399/55
5,678,136 A 10/1997 Watanabe et al. ..... 399/100
5,987,269 A 11/1999 Allen et al. ..... 399/27
6,456,804 B2 9/2002 Izawa et al. ..... 399/66
6,560,426 B2 * 5/2003 Sakaizawa et al. ..... 399/150
2002/0012542 A1 1/2002 Karakama et al. ..... 399/27

FOREIGN PATENT DOCUMENTS

JP 11-272060 10/1999
JP 2000-250380 9/2000

* cited by examiner

*Primary Examiner*—Hoan Tran
(74) *Attorney, Agent, or Firm*—Fitzpatrick, Cella, Harper & Scinto

(57) ABSTRACT

An image forming apparatus of an electrophotography system, in which 10<PS/|Hz1−Hz2| is satisfied where Hz1 indicates a frequency of charging bias, Hz2 indicates a frequency of developing bias, and PS indicates a peripheral speed of a photosensitive member, whereby preventing density unevenness in an image.

9 Claims, 14 Drawing Sheets

IMAGE FORMING APPARATUS

This application claims the right of priority under 35 U.S.C. § 119 based on Japanese Patent Application No. JP 2002-106686 which is hereby incorporated by reference herein in its entirety as if fully set forth herein.

BACKGROUND OF THE INVENTION

1. Field of the Invention

The present invention relates to an image forming apparatus such as a copying machine, a laser beam printer, or the like. An image forming apparatus is suited particularly to an electrophotography system, and include, for example, an electrophotographic copier, an electrophotographic printer (for example, an LED printer, a laser beam printer, or the like), an electrophotographic facsimile, and so on.

2. Description of the Related Art (Introduction of a Process Cartridge)

In image forming apparatuses of an electrophotography system such as a copying machine, a laser beam printer, or the like, a photosensitive member surface is first made uniform in electric potential, light corresponding to image information is irradiated on the photosensitive member to form a latent image (distribution of electric potential on the photosensitive member surface, corresponding to image information), a developer (toner) being a recording material is supplied onto the latent image by a developing means to make an image visible, and the image is transferred to a recording sheet from the photosensitive member to form an image on the recording sheet.

A toner container being a toner storage section is connected to the developing means and toner is consumed while images are formed. Generally, a toner container, a developing means, a photosensitive member, and a charging means are in many cases integrally constituted as process cartridge, and a user exchanges the process cartridge for a new one when toner runs out, whereby it becomes possible to form images again.

(Introduction of a Residual Detecting Means)

In order to know at any time how much toner for formation of images remains in a process cartridge, a developer residual quantity detecting means capable of successively detecting a level of toner residual quantity is in some cases provided in a process cartridge, or a body of an image forming apparatus (System of Measurement of an Electrostatic Capacity Among Electrodes)

A method of measuring an electrostatic capacity between electrodes of a plurality of electrode members as developer residual quantity detecting means, in which an additional circuit is comparatively simple and which is high in accuracy of detection, is disclosed in, for example, JP-A-2000-250380, JP-A-11-272060, and so on.

Such residual quantity detection system makes use of a phenomenon that an electrostatic capacity between electrodes varies according to a quantity of an insulating toner present between the both. When toner fills between the both, the electrostatic capacity is high. And as toner decreases, an air increases in amount between the both and the electrostatic capacity decreases.

Accordingly, an electrostatic capacity between the both and a toner residual quantity are beforehand related to each other, and then a level of toner residual quantity can be detected by measurement of electrostatic capacity. Such electrostatic capacity can be measured by applying a predetermined alternating bias for detection of residual quantity between electrodes and detecting an electric current value and a voltage value induced at that time.

The predetermined alternating bias for detection of residual quantity is in many cases common to a developing bias. That is, such toner residual quantity level detection system detects a level of toner residual quantity at a timing such as formation of image, or the like, in which a developing bias is applied to a developing roller.

(Relationship Among Process Speed, Charging Frequency, and Developing Frequency)

Subsequently, an explanation will be given to a relationship among a charging bias (charging voltage) applied to a charging device in order to make a surface of a photosensitive member uniform in electric potential, a developing bias (developing voltage) applied to a developing device in order to fly a developer so that a developer (toner) is adhered to a latent image formed on the uniformly charged photosensitive member surface by exposure, and a process speed (print speed). In addition, the larger a process speed, the larger a peripheral speed (moving speed of a photosensitive member surface) of a photosensitive drum.

With a configuration using a contact type charging device making use of a charging bias with a direct current component and an alternating component as superimposed and a non-contact type developing device making use of a developing bias with a direct current component and an alternating component as superimposed, an appropriate value of a frequency of the charging bias generally increases with a process speed (however, in the case where image resolution is the same). Meanwhile, a frequency of the developing bias involves an appropriate range in developing characteristics, irrespective of a print speed.

Conventionally, a frequency of the developing bias is set to a large value relative to a frequency of the charging bias while there has been caused a need of approximating a frequency of the developing bias and the frequency of the charging bias to each other since the frequency of the charging bias is increased due to an increase in process speed in recent years.

(Problems caused by Approximation of a Frequency of the Charging Bias and a Frequency of the Developing Bias to each other, and a Method of Avoiding the Same)

When a frequency of the charging bias approximates to a frequency of the developing bias, cyclic density unevenness appears, in some cases, on an image depending upon the relationship between frequencies and a process speed. This will be described later in detail.

In order to avoid this, it suffices that, for example, a frequency of a charging bias be made equal to frequency of a developing bias.

As described above, by making a frequency of a charging bias equal to frequency of a developing bias, it is possible to solve the problem involved in cyclic density unevenness.

In an apparatus, in which a plurality of electrode members are arranged and a developing bias is applied between electrodes thereof for detection of a developer residual quantity, however, there is caused a new problem that by making a frequency of a charging bias and a frequency of a developing bias the same, a detected value of a developer residual quantity shifts due to a phase difference between the two frequencies.

In particular, in the case where a residual quantity is sequentially detected, the shift of a detected value of a developer residual quantity may cause erroneous detection.

SUMMARY OF THE INVENTION

It is an object of the present invention to provide an image forming apparatus for prevention of cyclic density unevenness.

It is a further object of the invention to provide an image forming apparatus, in which an image unevenness caused by a difference between a frequency of a charging voltage and a frequency of a developing voltage is made unnoticeable.

It is a still further object of the invention to provide an image forming apparatus, in which a peripheral speed of an image bearing member can be set to be large.

It is a further object of the invention to provide an image forming apparatus, in which a frequency of a charging voltage and a frequency of a developing voltage are made substantially close to each other.

It is an object of the invention to provide an image forming apparatus, in which detection of a developer residual quantity is stabilized.

Further object and feature of the invention will be made further apparent when reading the following detailed description with reference to the accompanied drawings.

DESCRIPTION OF THE PREFERRED EMBODIMENTS

Preferred embodiments of the invention will be exemplarily described in detail with reference to the drawings. It is to be understood that the invention is not limited in its scope to dimensions, materials, shapes, and relative arrangements of constituent parts described in the embodiments unless specifically described.

An explanation will be given to an image forming apparatus according to the embodiments of the invention with reference to FIGS. 1 to 14.

(An Explanation of a General Printer (an Example of an Image Forming Apparatus) and a Process Cartridge)

In the embodiments, a laser beam printer for receiving image information from a host computer, network, or the like to output an image onto a recording paper according to it will be described as an example of the image forming apparatus. Also, a process cartridge is configured to be detachable from a printer body for exchange in the laser beam printer.

Figure 1:
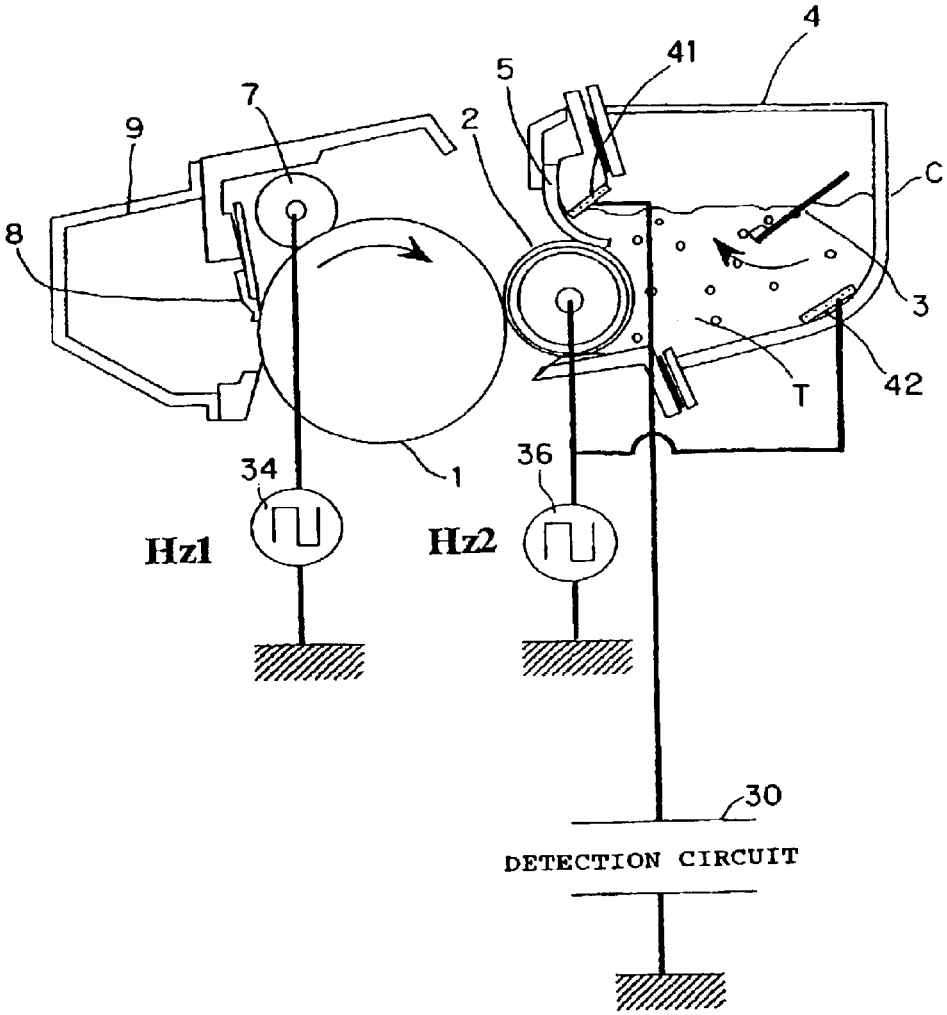
FIG. 1 is a schematic, cross sectional view showing a process cartridge according to an embodiment of the invention.
Figure 2:
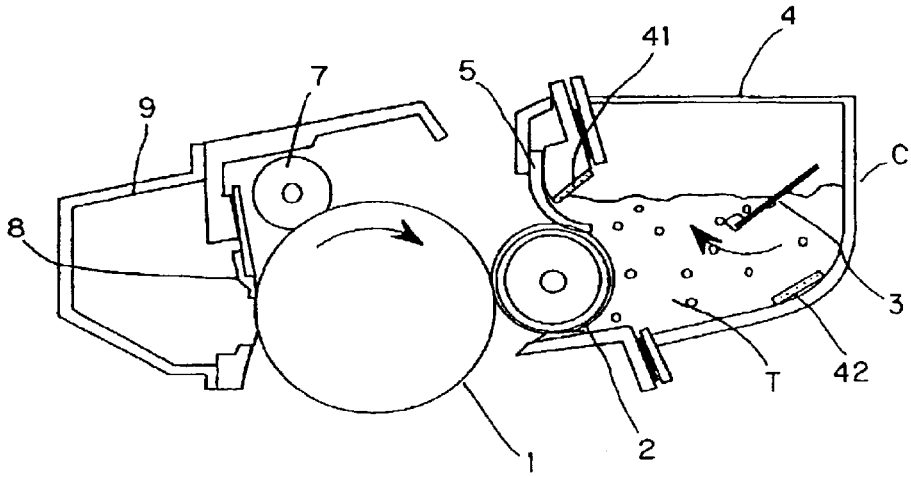
FIG. 2 is a schematic, cross sectional view showing the process cartridge according to the embodiment of the invention.

First, an explanation will be given to the process cartridge with reference to particularly FIGS. 1 and 2. FIGS. 1 and 2 are schematic, cross sectional views showing the process cartridge according to the embodiments of the invention, FIG. 1 also showing a part of a circuit configuration.

As shown in the figures, the process cartridge C integrally comprises a photosensitive member 1 being a latent image bearing member, a contact charging member (charging roller) 7 provided in contact with the photosensitive member and serving as a charging means for uniformly charging a surface of the photosensitive member 1, and a developer bearing member (developing roller) 2 arranged in non-contact with and opposed to the photosensitive member 1 and serving as a development means for developing a latent image, which has been formed by exposure, with toner as a developer after surface potential is made uniform by the charging means 7.

Also, the process cartridge C integrally comprises a toner regulating member 5 for making toner on the surface of the developing roller 2 a uniform thin layer, a toner container 4 connected to the toner regulating member 5 to serve as a storage portion of toner T, agitating blades 3 for agitating toner in the toner container 4, a cleaning means 8 for cleaning residual toner on the photosensitive member 1, and a waste toner container 9 for storing a waste toner having been removed from the photosensitive member 1 by the cleaning means 8.

Figure 3:
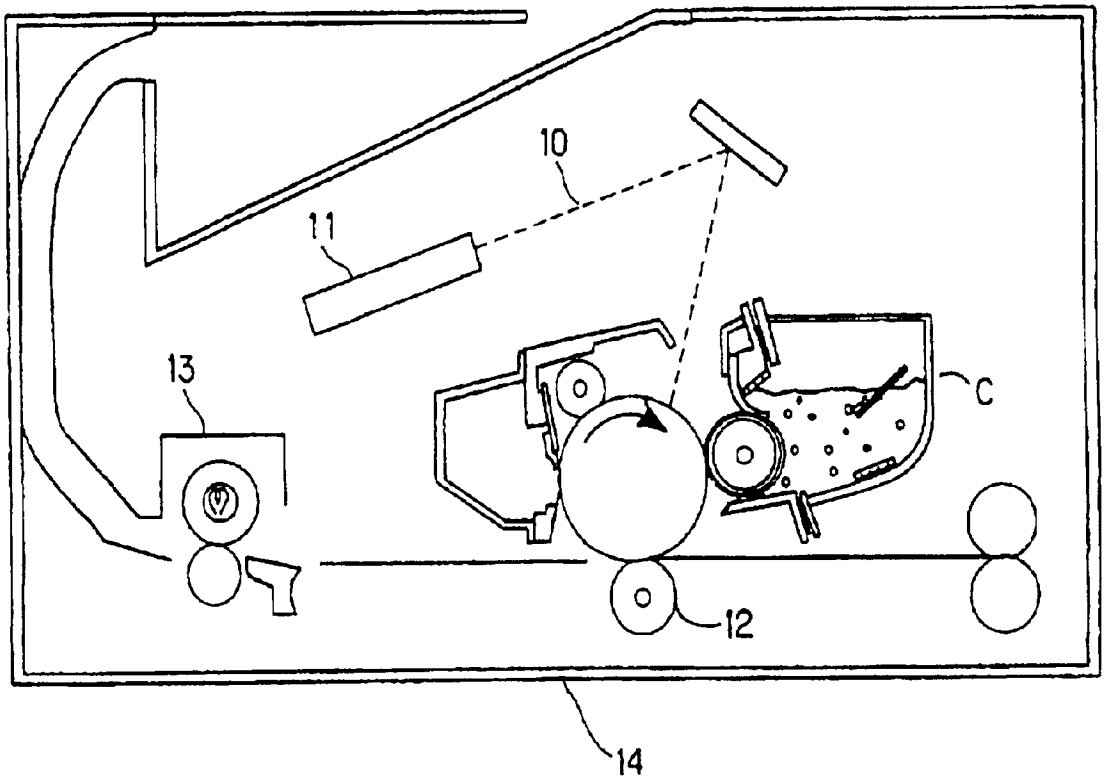
FIG. 3 is a schematic, cross sectional view showing an image forming apparatus according to the embodiment of the invention.

Subsequently, an explanation will be given to an image forming apparatus mounting thereon the process cartridge C particularly with reference to FIG. 3. FIG. 3 is a schematic cross sectional view showing an image forming apparatus according to an embodiment of the invention.

A laser printer 14 being an image forming apparatus comprises, as shown in the figure, a laser scanner 11 provided above the process cartridge C to serve as an exposure means for irradiating laser beams 10 corresponding to image information, and a transfer means 12 arranged in a position below the process cartridge C and opposed to the photosensitive member 1.

In the above configuration, the charging means 7, to which charging bias (charging voltage) is applied, uniformly charges the surface of the photosensitive member 1, and the surface is scanned and exposed by laser beams 10 irradiated from the laser scanner 11, whereby an electrostatic latent image of a target image information is formed. An action of the developing roller 2, to which charging bias (charging voltage) is applied, causes toner T in the toner container 4 to adhere to the electrostatic latent image to visualize the image as toner image.

Here, in the embodiment, both the developing bias and the charging bias constitute a superimposed voltage of a direct current voltage (direct current component) and an alternating voltage (alternating component). In addition, in the embodiment, an insulating magnetic one-component toner is used as the toner T. The developing roller 2 comprises a cylindrical-shaped conductive metallic sleeve (developing sleeve), and a magnet provided inside the sleeve. The developing bias is applied on the metallic sleeve and toner is carried on the metallic sleeve by magnetic force of constraint of the magnet.

A toner image on the photosensitive member 1 is transferred to a recording sheet by the transfer means 12. The recording sheet passes through a fixing means 13 to have the toner image fixed on the recording sheet to be discharged outside the body.

(An Explanation of a Constitution of Electrode Metal Plates Provided in the Cartridge and a Flow of Detection of a Toner Residual Quantity)

As shown in FIGS. 1 and 2, fixed to and arranged in the toner container 4 of the process cartridge Care two parallel metal plates, that is, a first plate antenna metal plate 41 (referred below to as first PA41) and a second plate antenna metal plate 42 (referred below to as second PA42), as electrode metal plates.

Further, as shown in FIG. 1, a circuit in the image forming apparatus is designed to put the developing sleeve of the developing roller 2 and the second PA42 in the same potential. In the equivalent circuit, it is meant that capacitor consisting of the developing sleeve and the first PA41 and capacitor consisting of the first PA41 and the second PA42 are connected in parallel.

Here, composite electrostatic capacities between the developing sleeve and the first PA41 and between the first PA41 and the second PA42 are measured by measuring a quantity of electric current induced on the first PA41 when the developing bias is applied on the developing sleeve (in addition, the bias is also applied on the second PA42). That is, the quantity of toner in the toner container is detected corresponding to a quantity of electric current flowing through the first PA41.

(An Explanation of a Detection Sequence)

Figure 4:
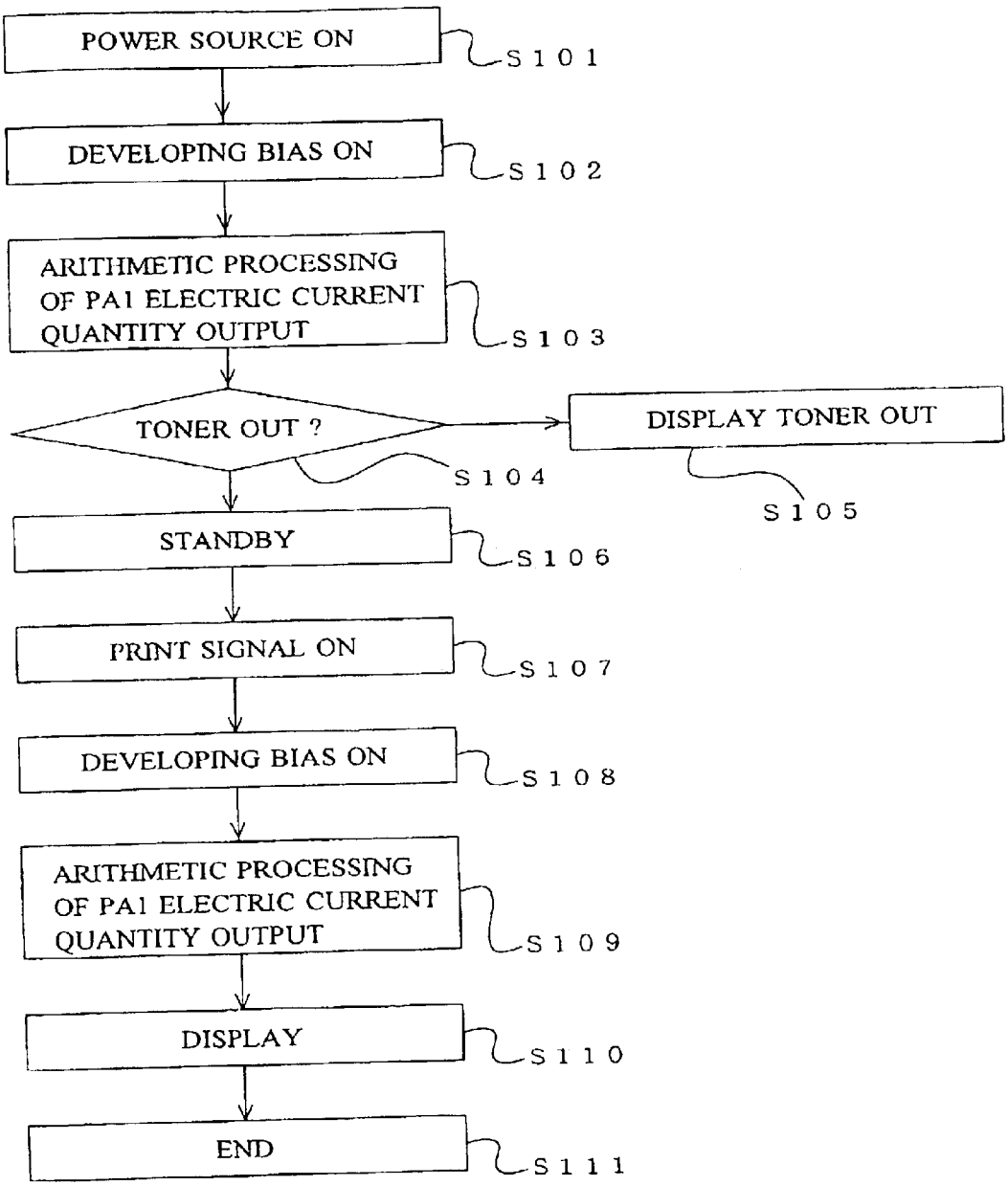
FIG. 4 is a flowchart for detection of a residual quantity of a developer (toner) in a developing device according to the embodiment of the invention.
Figure 5:
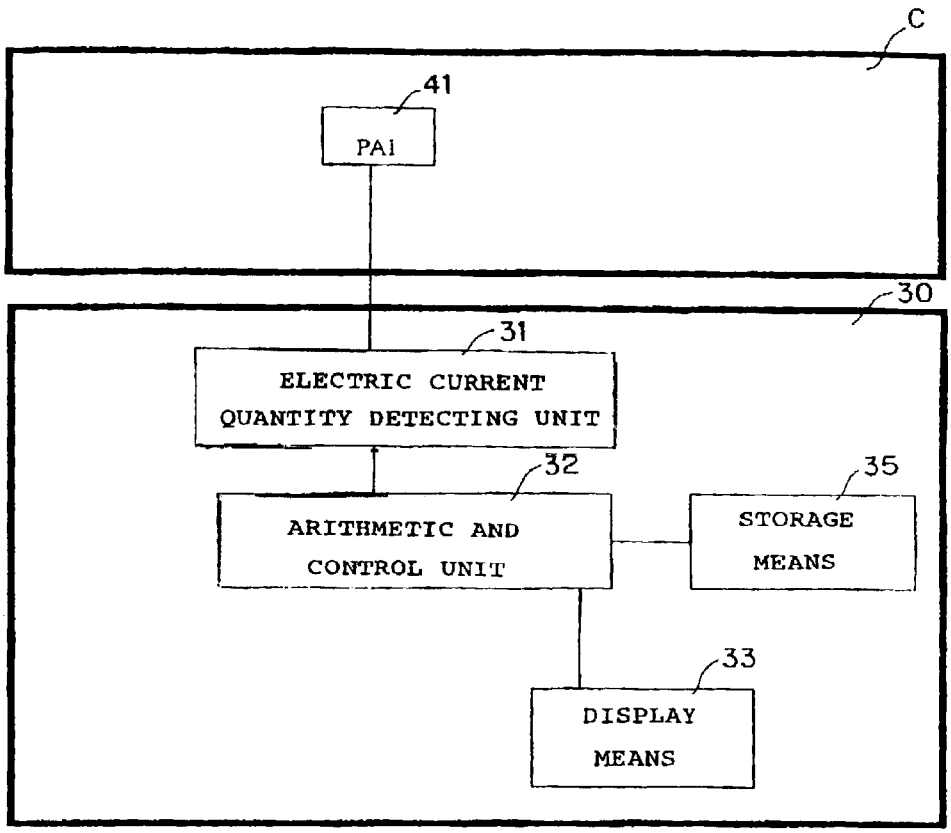
FIG. 5 is a circuit diagram of main components in the developing device according to the embodiment of the invention.

In particular, with reference to a flowchart shown in FIG. 4 and circuit configurations shown in FIGS. 1 and 5, an explanation will be given to a method of detecting a toner residual quantity in the embodiment. FIG. 4 shows a flowchart for detection of a residual quantity of a developer (toner) in a developing device according to the embodiment. FIG. 5 is a circuit diagram of main components in the developing device according to the embodiment.

In the embodiment, non-magnetic stainless steel material was used as metal plate material for the first PA41 and the second PA42, and the respective parts were arranged such that a distance between the developing roller 2 and the first PA41 was 2 mm and a distance between the first PA41 and the second PA42 was 50 mm.

First, when a power source is made ON, driving of the body and the cartridge is started (S101). When the developing bias is applied (S102), measurement of a toner residual quantity is started, and a detection circuit 30 detects a quantity of electric current flowing through the first PA41 to perform an arithmetic processing (S103).

Here, the detection circuit 30 comprises, as shown in FIG. 5, an electric current quantity detecting unit 31 for detecting an electric current quantity, an arithmetic and control unit 32 for performing a predetermined arithmetic processing on the detected electric current quantity to convert electrostatic capacity into a toner residual quantity, storage means 35 for storing results of detection of a toner residual quantity, and display means 33 for displaying them, for example, in terms of percentage on the printer body.

And in the case where results processed in the arithmetic and control unit 32 determine toner out, that is, absence of a toner residual quantity for printing, the display means 33 performs displaying to that effect (S105). Otherwise, the procedure comes into a standby state to wait for a next print signal (S106).

When the print signal is made ON (S107), the same sequence as that when the power source is made ON comes on fundamentally. More specifically, when the developing bias is applied (S108), measurement of a toner residual quantity is started, the detection circuit 30 detects a quantity of an electric current flowing through the first PA41 to perform an arithmetic processing (S109). And results of the residual quantity are displayed (S110), and the job is terminated (S111).

The determined value is converted into a form indicated in the display means 33, for example, percent indication to display the same on the display means 33 or an external device through network or the like (S109).

The embodiment comprises the electric current quantity detecting unit 31 for detecting an electric current value to detect an electric current value every 4 msec. Such values are sequentially stored, and in a step, in which 255 values have been stored, an average value of the 255 values is found (about one second). The average value of the 255 values is transmitted as a representative value to the arithmetic and control unit 32 to be converted into a value of a developer residual quantity.

(An Explanation of Problems Caused by Frequency)

In the embodiment, detection of a toner residual quantity is performed in the sequence. The relationship between frequency of the developing bias and frequency of the charging bias as used in the sequence causes generation of density unevenness in an output image in a constant cycle and large variation in detected values of a toner residual quantity.

An explanation will be given below to the cause of generation of density unevenness and the cause of large variation in detected values of a toner residual quantity.

(The Cause of Generation of Density Unevenness)

In the case where an alternating bias is used as the charging bias to perform charging, cyclic potential unevenness according to its frequency is generated on the surface of the photosensitive member. For example, in the case where the moving speed of the surface of the photosensitive member is 200 mm/sec and frequency of the charging bias is 2000 Hz, potential unevenness in a cycle of (200/2000) mm=100 $\mu$m will be generated on the surface of the photosensitive drum in a direction of motion of the photosensitive drum.

At this time, in the case where the developing bias composed only of a direct current component is used to perform developing, density unevenness in a cycle of 100 $\mu$m will be generated. However, since human eyes have no resolution to recognize that in a cycle of 100 $\mu$m, no serious problem is caused.

Meanwhile, in the case where an alternating bias is used for both the charging bias and the developing bias as in the embodiment, the surface of the photosensitive drum is put in a potential affected by both the charging bias and the developing bias in a timing, in which the both biases are simultaneously applied.

As a result, when both the charging bias and the developing bias have alternating components, a cyclic density unevenness recognizable by human eyes is generated depending upon frequencies and process speeds of the both biases.

(Experiments on the Cause of Generation of Density Unevenness)

Figure 6:
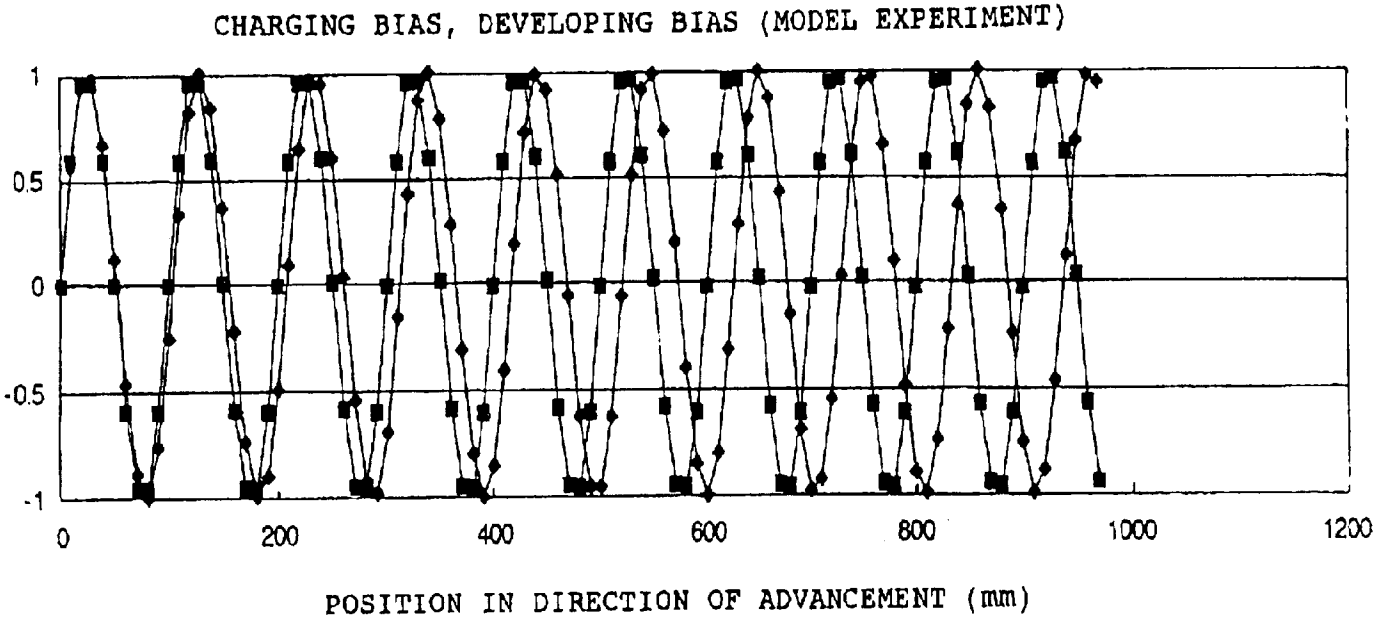
FIG. 6 is a view showing a condition of a charging bias and a developing bias in a model experiment.

Using a concrete model experiment, an explanation will be given to the cause of generation of density unevenness referring to FIGS. 6 to 13. FIG. 6 is a view showing conditions of a charging bias and a developing bias in the model experiment. FIGS. 7 to 13 show composite waves of the charging bias and the developing bias in the model experiment.

In the model experiment, the charging bias and the developing bias are subjected to a condition shown in FIG. 6 for simplicity. That is, (1) direct current components of the both biases are not taken into account, (2) variations in the both biases present precise sinusoidal waves, (3) the both biases start from 0 point, and (4) the both biases are the same in amplitude. In addition, biases of two kinds shown in FIG. 6 represent the charging bias and the developing bias but whichever of the biases may be the charging bias or the developing bias.

In FIGS. 7 to 13, the abscissa designates a position in a direction of motion of the photosensitive drum, unit of which is mm. Also, the ordinate designates a composite of waves of charging intensity and developing intensity, and the composite has no physical meaning but both the charging intensity and developing intensity constitute main parameters to determine an image density, so that the composite wave is considered to have a certain correlation with the image density.

Also, in FIGS. 7 to 13, (a) and (b) indicate the case where starting is made in a direction, in which two biases intensify each other at the start (that is, the same phase), and (c) and (d) indicate the case where starting is made in a direction, in which two biases weaken each other at the start (that is, opposite phases). Also, (a) and (b), and (c) and (d), respectively, show composite waves with different magnification along the abscissa, (b) and (d) indicating the cases of being higher in magnification than those in (a) and (c).

FIGS. 7 to 10 show composite waves in the case of being varied in charging frequency and developing frequency when the process speed is constant (process speed: 200 mm/sec). The charging frequency and developing frequency are as follows.

Figure 7:
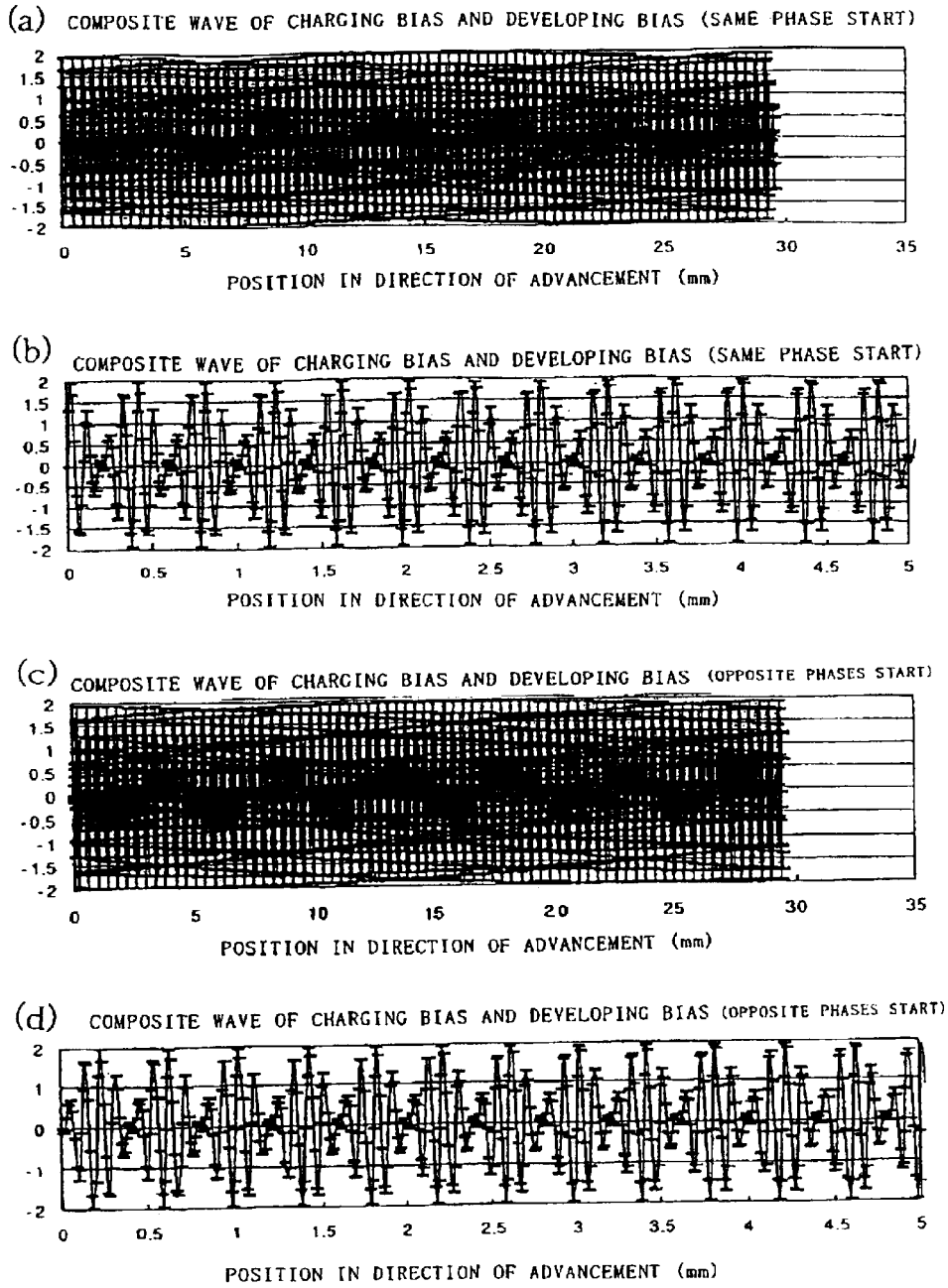
FIG. 7 shows a composite wave of the charging bias and the developing bias in the model experiment.
Figure 8:
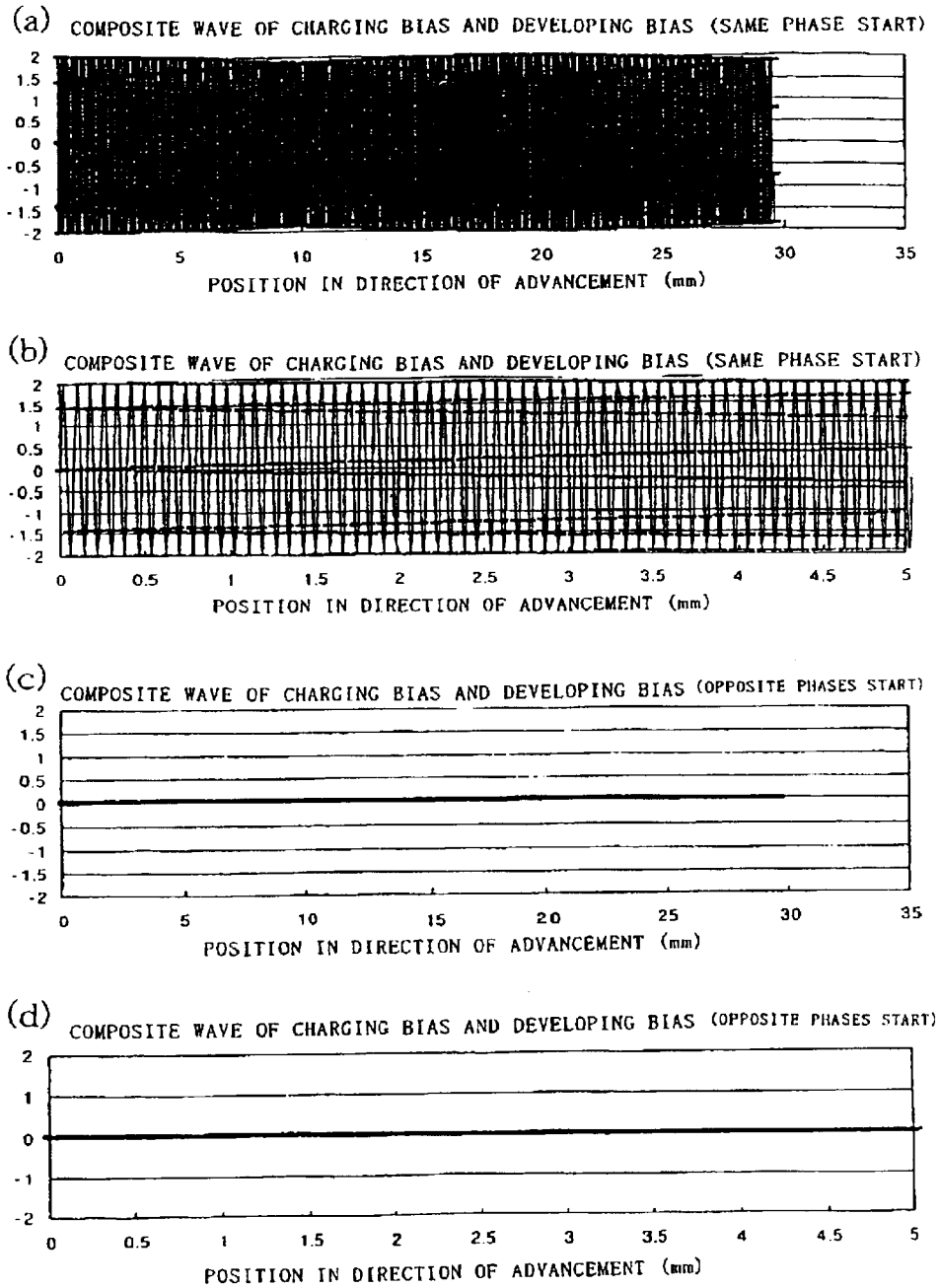
FIG. 8 shows a composite wave of the charging bias and the developing bias in the model experiment.
Figure 9:
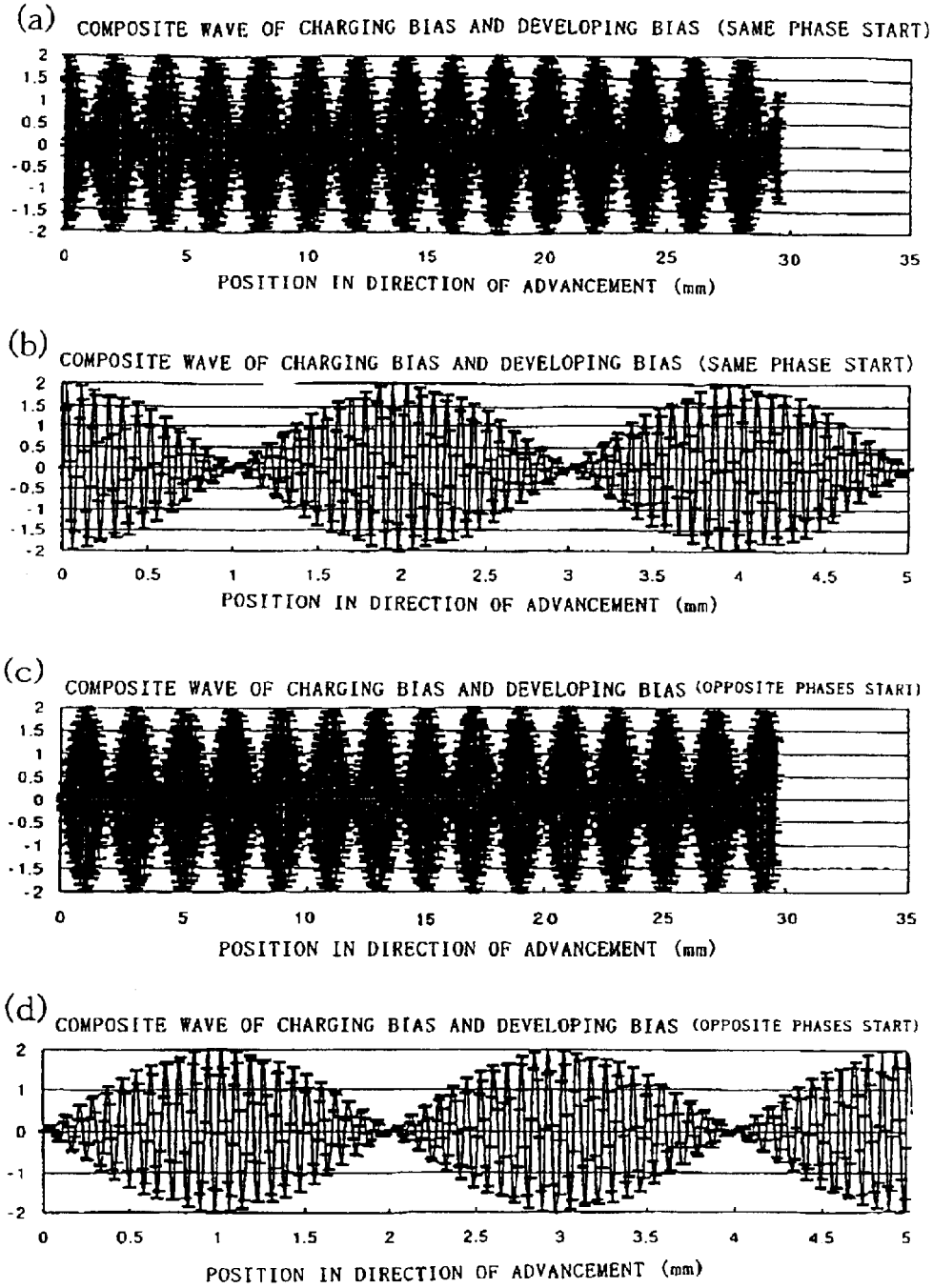
FIG. 9 shows a composite wave of the charging bias and the developing bias in the model experiment.
Figure 10:
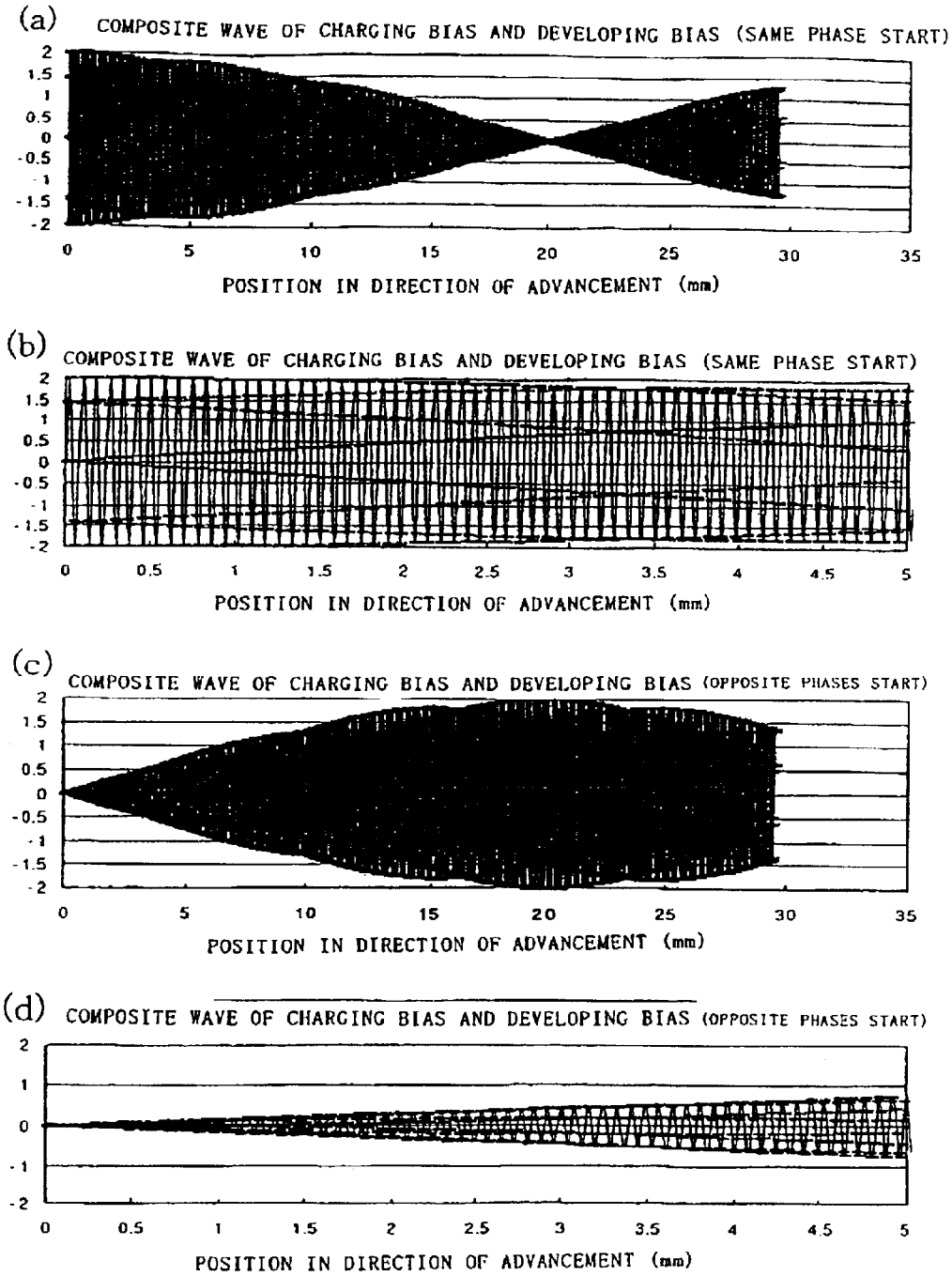
FIG. 10 shows a composite wave of the charging bias and the developing bias in the model experiment.

In the case shown in FIG. 7 the charging frequency is 2000 Hz and the developing frequency is 2500 Hz, in the case shown in FIG. 8 the charging frequency is 2500 Hz and the developing frequency is 2500 Hz, with the case shown in FIG. 9 the charging frequency is 2400 Hz and the developing frequency is 2500 Hz, and in the case shown in FIG. 10 the charging frequency is 2495 Hz and the developing frequency is 2500 Hz.

FIG. 9 and FIGS. 11 to 13 show composite waves in the case where the charging frequency and developing frequency are constant (charging frequency: 2400 Hz, and developing frequency: 2500 Hz) and the process speed is varied. The process speed is as follows.

Figure 11:
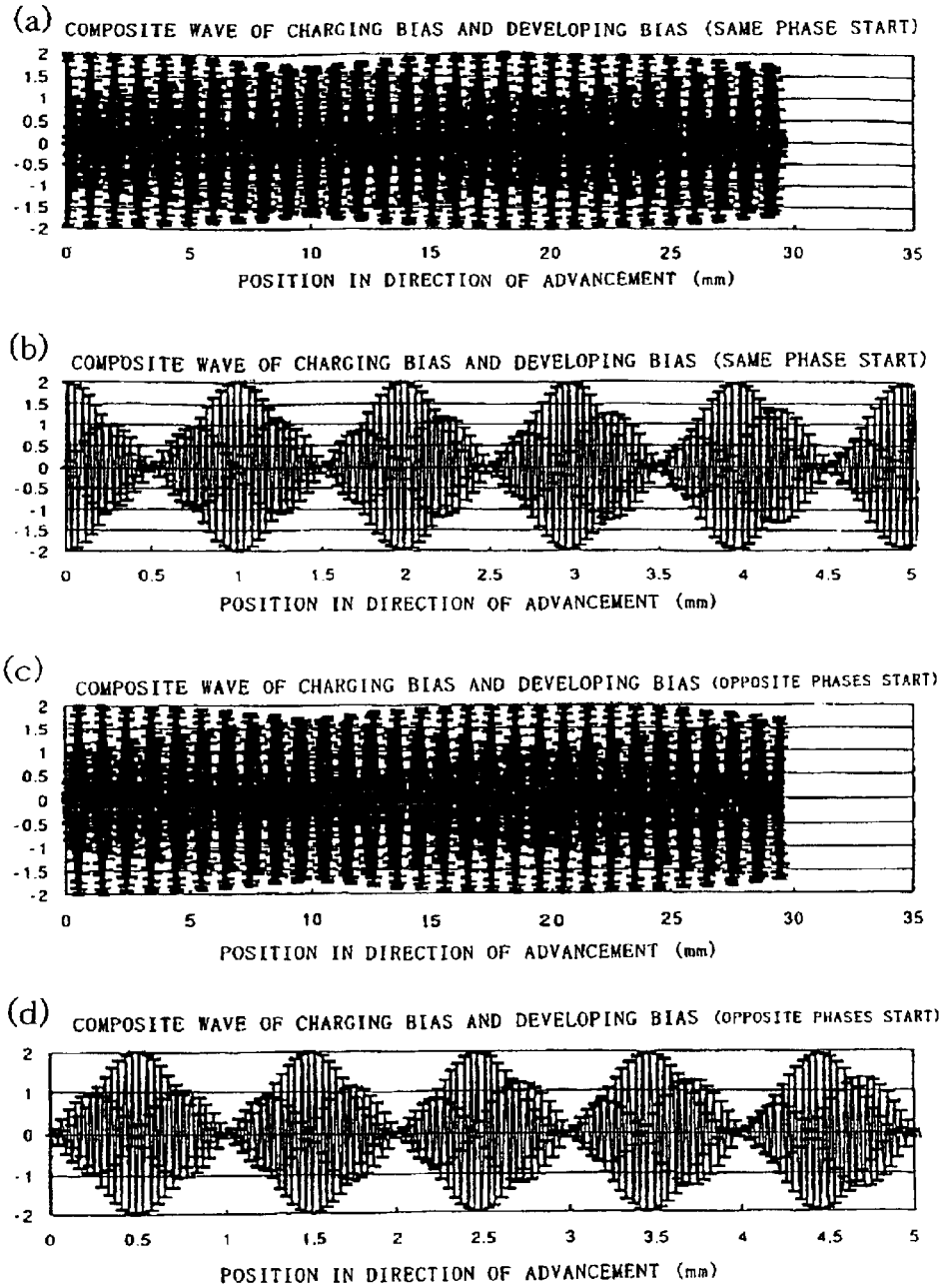
FIG. 11 shows a composite wave of the charging bias and the developing bias in the model experiment.
Figure 12:
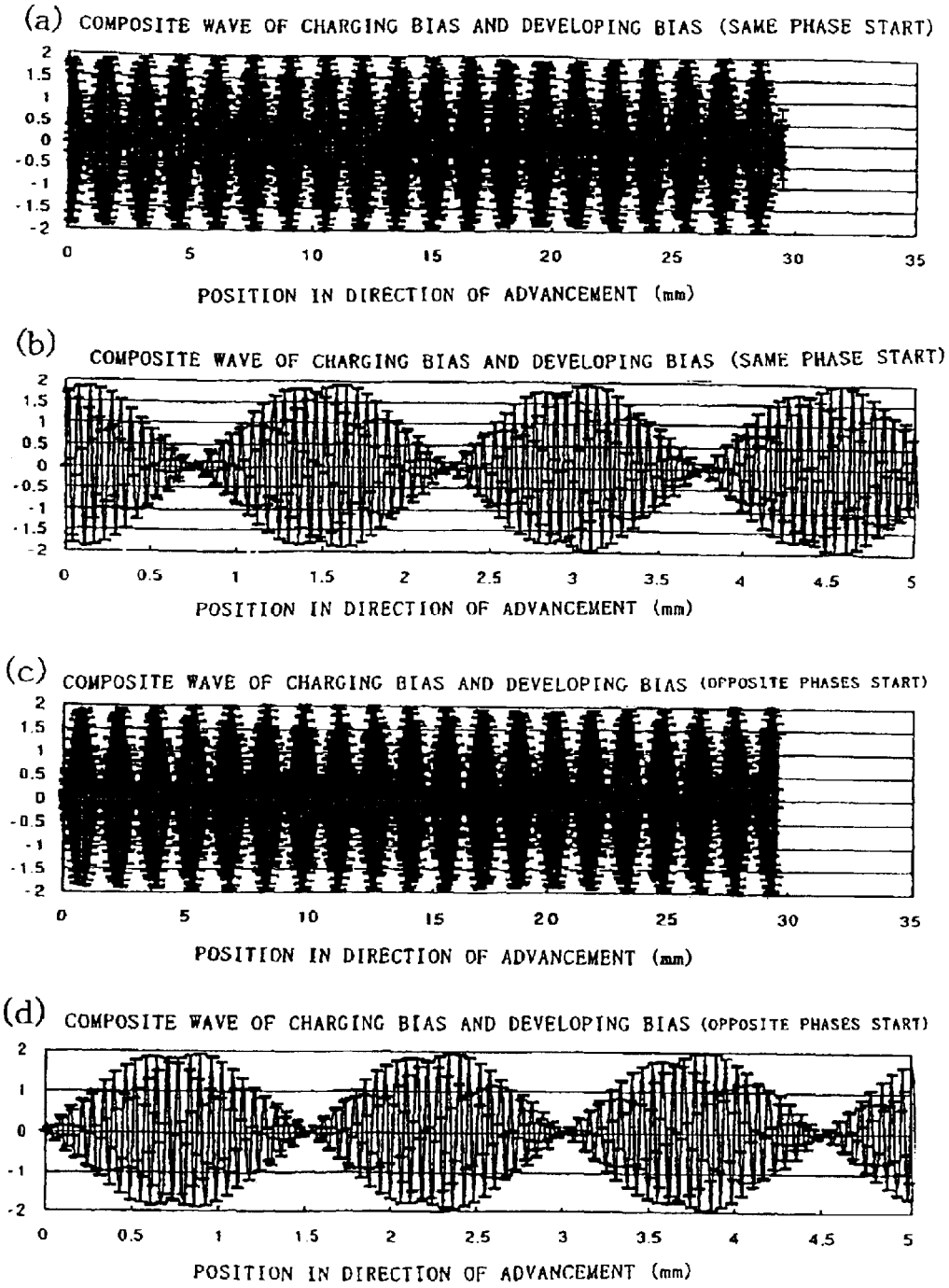
FIG. 12 shows a composite wave of the charging bias and the developing bias in the model experiment.
Figure 13:
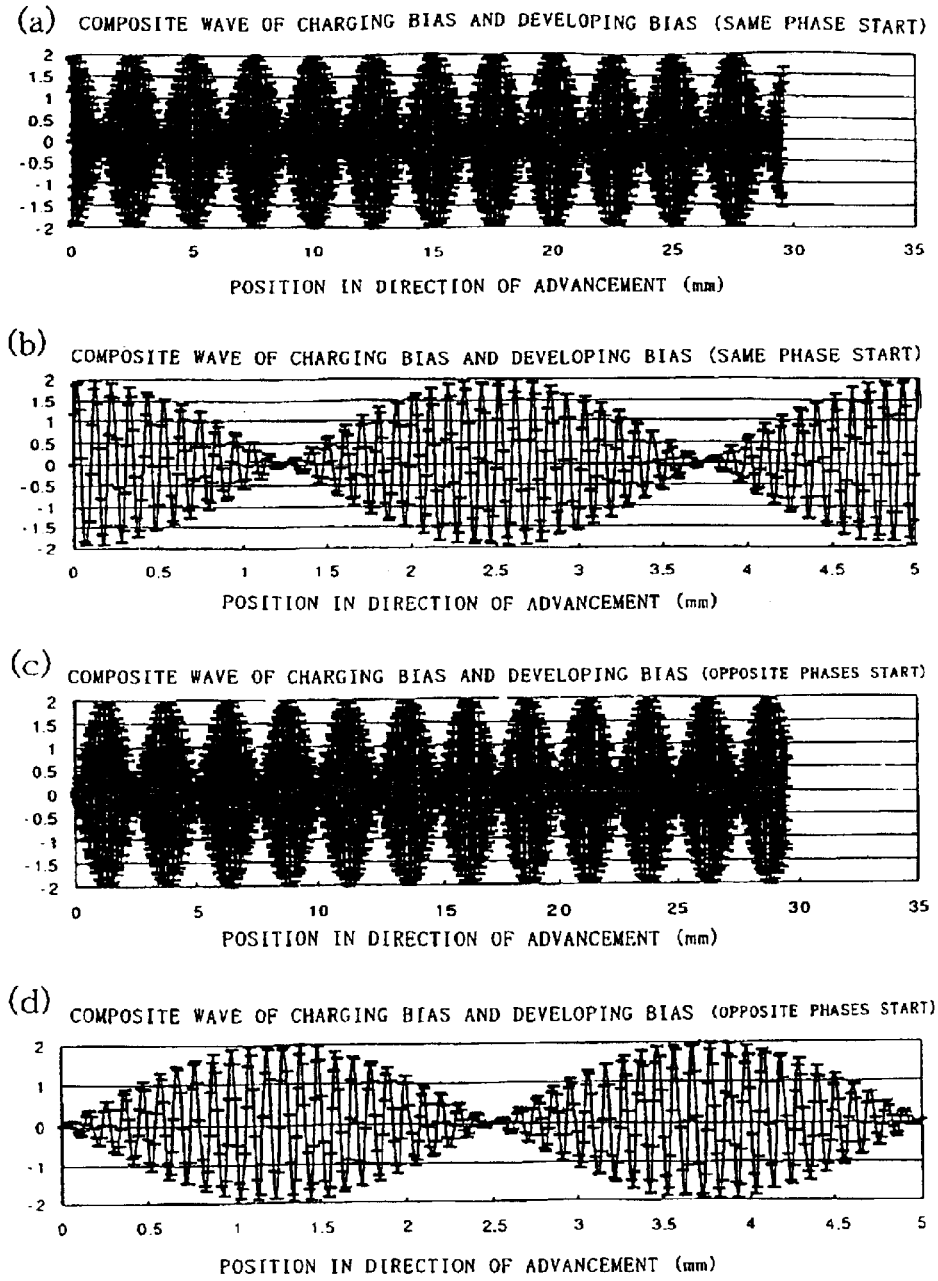
FIG. 13 shows a composite wave of the charging bias and the developing bias in the model experiment.

In the case shown in FIG. 11 the process speed is 100 mm/sec, in the case shown in FIG. 12 the process speed is 150 mm/sec, in the case shown in FIG. 9 the process speed is 200 mm/sec, and in the case shown in FIG. 13 the process speed is 250 mm/sec.

First, an explanation will be given to the relationship between frequency and image density referring to FIGS. 7 to 10. In addition, the process speed is 200 mm/sec and the same in the cases shown in FIGS. 7 to 10.

In FIG. 7, two frequencies, that is, charging frequency and developing frequency, are comparatively much different from each other. Taking notice of FIG. 7(*b*) and FIG. 7(*d*), it is found that two waveforms intensify each other much in a cycle of about 0.4 mm. That is, density unevenness is generated in this cycle. The cycle of density unevenness is found by peripheral speed of image bearing member/|charging frequency−developing frequency|=200/|2000−2500|=0.4.

Since a cycle of 0.7 mm or less cannot be recognized by the resolution of human eyes, however, density unevenness is not seen in frequencies shown in FIG. 7. This is the same with the case in FIG. 7(*d*) where two waves start in opposite phases.

In FIG. 8, two frequencies, that is, charging frequency and developing frequency, assume the same value. In this case, it is found that the behavior of composite waves differ much between the case where they start in the same phase as shown in FIG. 8(*a*) and FIG. 8(*b*) and the case where they start in opposite phases as show in FIG. 8(*c*) and FIG. 8(*d*)

In the case where they start in the same phase, waveforms intensify each other in a cycle of 80 $\mu$m (=200/2500). That is, density unevenness is generated in this cycle. In this case, however, discrimination of density unevenness is impossible with human eyes.

Meanwhile, in the case where they start in opposite phases, composite waves involve no cycle since the waves weaken each other at all times. However, since two frequencies, that is, a charging frequency and a developing frequency, are different in intensity from each other, the resulting cycle of 80 $\mu$m cannot be actually recognized with human eyes.

FIG. 9 shows the case where a difference between two frequencies, that is, a charging frequency and a developing frequency, is comparatively small. In this case, density unevenness is generated in a cycle of 2.0 mm (200/|2400−2500|). This interval is recognizable with human eyes to cause a problem problematic in a resulting image, and so not preferable. This tendency is the same with the same phase and opposite phases.

FIG. 10 shows the case where a difference between two frequencies, that is, charging frequency and developing frequency, is very small. In this case, density unevenness is generated in a cycle of 40 mm (200/|2495−2500|). In addition, although not specifically shown, it has been found as a result of observation with frequencies varied that in the case where frequencies are close to but different from each other, the smaller a difference therebetween, the larger a cycle of density unevenness.

With the case shown in FIG. 10, the cycle of density unevenness is 40 mm and can be recognized with human eyes, but causes no problem in a resulting image for the following reason.

When a cycle of density unevenness is larger than 10 mm in a direction of motion of the photosensitive drum, density varies in a small rate and so it is hard to recognize density unevenness.

That is, a comparatively long cycle causes density to vary slowly in a direction of motion of the photosensitive drum, so that it is hard to recognize density unevenness.

Subsequently, an explanation will be given to the relationship between process speed and density unevenness referring to FIGS. 11 to 13 and FIG. 9. In addition, the charging frequency is 2400 Hz, and the developing frequency is 2500 Hz, the both being constant.

As apparent from the respective figures, a cycle of a composite wave is 1.0 mm (100/|2400−2500|) for the process speed of 100 mm/sec (the case shown in FIG. 11), a cycle of a composite wave is 1.5 mm (150/|2400–2500|) for the process speed of 150 mm/sec (the case shown in FIG. 12), a cycle of a composite wave is 2.0 mm (200/|2400–2500|) for the process speed of 200 mm/sec (the case shown in FIG. 9), and a cycle of a composite wave is 2.5 mm (250/|2400–2500|) for the process speed of 250 mm/sec (the case shown in FIG. 13).

Therefore, it is found that a cycle of a composite wave, that is, a cycle of density unevenness increases in proportion to a process speed.

What is found from the above results is summarized as follows.

(1) When it is necessary to set frequencies of the charging bias and the developing bias relatively close to each other, a cyclic density unevenness is liable to occur, and decreasing a difference between frequencies to some degree as shown in FIG. 9 is not enough, so that it is necessary to make a difference between frequencies very small as shown in FIG. 10. That is, since density unevenness is not recognizable with eye when a cycle thereof is 0.7 mm or less as shown in FIG. 7, there is inherently caused no problem, but when a cycle exceeds 0.7 mm, there is caused a problem. Since a cycle is conversely increased much in FIG. 10, it becomes hard to recognize density unevenness.

(2) In the case where frequencies of the charging bias and the developing bias are one and the same, no cyclic density unevenness is generated.

(3) In considering a cycle of density unevenness, there is a need of taking an adequate account of influences by the process speed.

Here, generation of cyclic density unevenness is conventionally prevented by setting the charging bias and the developing bias to one and the same, as in (2).

(Relationship between a Cycle of a Composite Wave and an Actual Density)

On above explained relationship between a cycle of a composite wave and an actual image density, an experiment was performed on the following conditions.

The relationship between a cycle of a composite wave and an actual image density was examined on an experimental condition, in which a vertical line pattern of 600 dpi, 2 dot 3 space was printed. In addition, the vertical line pattern of 2 dot 3 space was one, in which 2 dots printing (ON over 2 lines of laser) and 3 dot blanks (OFF over 3 lines of laser) were repeated in a direction (direction along a generating line of an image bearing member) perpendicular to a direction of advancement of a printing sheet (transfer material), and such pattern was successively formed on a printing sheet.

Through the experiment on this condition we confirmed that a cycle of a composite wave and a cycle of an actual density unevenness were one and the same.

(Main Cause for Variation in Residual Quantity Values (Theory))

In the embodiment, the developing bias serves as a bias for detection of residual quantity when a toner residual quantity is to be detected, and values of a toner residual quantity are detected by measuring an electric current quantity induced on the first PA41 at the time of bias application.

The electric current quantity induced at this time is varied by frequency and voltage width (Vpp) of an alternating bias applied. Accordingly, in order to perform correct detection, it is preferable to decide a predetermined alternating bias and to prepare beforehand a conversion table describing the relationship between an induced current value and a toner residual quantity value when the bias is used, thus using the predetermined bias and the predetermined conversion table to detect a toner residual quantity value.

Here, when the charging bias is applied, it acts on the first PA41 in some cases. In these cases, an electric current is induced from the first PA41 by a composite wave of a bias (the same as the developing bias in the embodiment) for detection of residual quantity and the charging bias. The induced current value described above is varied by a frequency and voltage width (Vpp) of an alternating bias applied, so that attention is needed in the case where the composite wave is applied.

(Main Cause for Variation in Residual Quantity Values (Experiment))

Here, with the same toner quantity under the condition shown in FIGS. 7 to 13, we observed change of output voltage with time. As a result, it was found that the induced current value was also varied in a cycle of a composite wave under any condition except the condition that two frequencies of the charging frequency and the developing frequency were only slightly different from each other as shown in FIG. 10. Accordingly, it was found that a current value being measured was varied depending upon a timing of measurement.

In the embodiment, however, 255 current values are prepared through measurements at 4 msec intervals and an average value of the 255 current values (about one second) is used as a representative value of the current values. This is an average value in a range corresponding to a travel of about 200 mm, over which the image bearing member is moved, on the abscissa shown in FIGS. 7 to 13 in the case of the printing speed of 200 mm/sec. This range is very large in terms of a cycle of a composite waveform. Accordingly, since the average value of current values every 4 msec in such range is used as a representative value, little variation corresponding to timing of measurement is detected in current values. When a travel of the image bearing member corresponding to one timing of measurement of 4 msec corresponds accurately and completely to a cycle of a composite wave, variation is generated in current values, but one timing of measurement is not always the same but shifts somewhat, so that little variation is detected in current values.

Also, provided that influences of the charging bias are also taken into account in preparation of the predetermined conversion table, no serious problem is caused with respect to accuracy of detection.

In the case where a difference between frequencies is very small as shown in FIG. 10, however, a cycle of a composite wave is much increased. Therefore, when "a representative value decision time (a range of time, in which current values used for calculation of an average value are included) for deciding a representative value of an electric signal used for conversion" is comparatively short, being intensely affected by the cycle of the composite wave, detected values are consequently varied by timing of detection.

As the result of actually measuring residual quantity detecting values a plurality of times with frequency varied, it was found that when the following relationships were satisfied, variation of residual quantity detecting values based on bias application timing ranged within around 10 percent.

(1) PS×Ca1_t should be an integral multiple of a cycle of a composite wave.

Alternatively, (2) PS×Ca1_t should be or larger than four times a cycle of a composite wave.

Here, Ca1_t indicates a representative value decision time (sec) for deciding a representative value of an electric signal used for conversion, PS is a process speed (mm/sec), and PS×Ca1_t indicates a distance (mm), over which a surface of a photosensitive drum moves while an electric signal used for conversion is decided. According to the embodiment, Ca1_t amounts to 4 msec×255≈1 sec.

(An Explanation with Respect to a Cycle of a Composite Wave)

The cycle of a composite wave can be represented by the following formula on the basis of the relationship between frequencies of respective biases and a process speed as indicated previously.

Cycle of a Composite Wave=PS/|Hz1−Hz2|

Here, Hz1 indicates a frequency (Hz) of charging bias, Hz2 indicates a frequency (Hz) of developing bias, and PS indicates a peripheral speed of a photosensitive member (mm/sec).

(One Solution)

Based on the above, in order to prevent variation of developer residual quantity detecting values based on bias application timing, it is preferred that the following relationship hold good among a process speed PS, a representative value decision time Ca_t for deciding a representative value of an electric signal used for conversion, and frequencies Hz1, Hz2 of respective biases.

Ca1_t×|Hz1-Hz2|>4 or Ca1_t×|Hz1−Hz2|=1 or Ca1_t×|Hz1−Hz2|=2 or Ca1_t×|HZ1−Hz2|=3 or Ca1_t×|HZ1−Hz2|=4

(Main Cause for Dispersion in Residual Quantity Values (Continued))

Also, it is found that in the case where two frequencies are equal as shown in FIG. 8, a composite wave differs much depending upon whether two waves start in the same phase in FIG. 8(*a*) and FIG. 8(*b*) or in opposite phases in FIG. 8(*c*) and FIG. 8(*d*).

Figure 14:
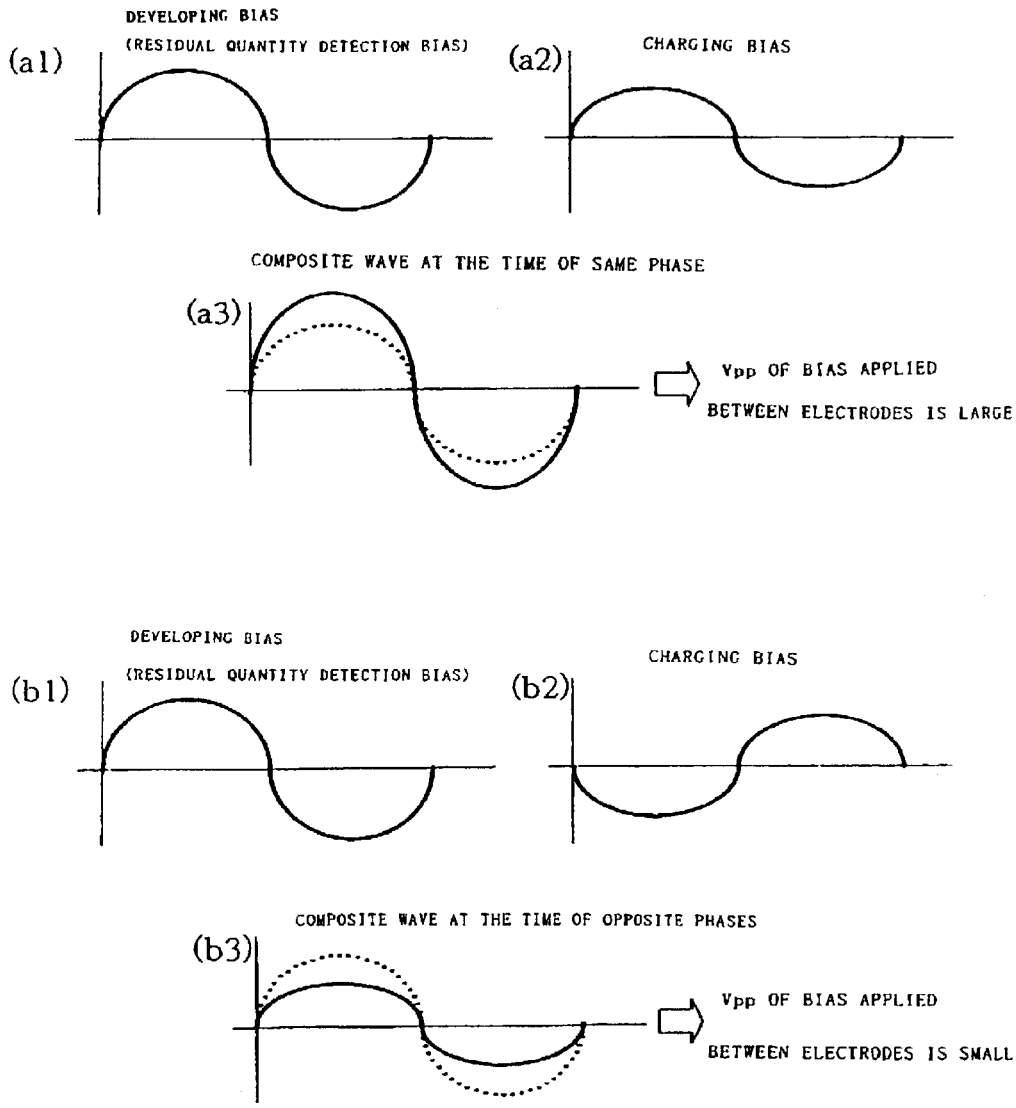
FIG. 14 shows illustrations of composite waves in the case where frequencies of the developing bias and the charging bias are the same.

This will be described in detail referring to FIG. 14. FIG. 14 shows illustrations of composite waves in the case where frequencies of the developing bias and the charging bias are the same.

In FIG. 14, FIG. 14(*a*1) shows one cycle of the developing bias, FIG. 14(*a*2) shows one cycle of the charging bias, and FIG. 14(*a*3) shows a composite wave in the case where the two biases are in the same phase. Also, in order to facilitate comparison with the composite wave, the developing bias shown in FIG. 14(*a*1) is indicated by a dotted line in FIG. 14(*a*3).

Likewise, FIG. 14(*b*1) and FIG. 14(*b*2) show the developing bias and the charging bias, and FIG. 14(*b*3) shows a composite wave in the case where the two biases are in opposite phases. Here, such composite wave is applied between electrodes for detection of developer residual quantity detection.

As apparent from a comparison between FIG. 14(*a*3) and FIG. 14(*b*3), in the case where frequencies of two biases are equal, composite waves always intensify each other when they are in the same phase, and composite waves always weaken each other when they are in opposite phases.

As described above, since an electric current quantity induced is affected by voltage width (Vpp) applied between electrodes for detection of developer residual quantity detection, detected values differ much in the case where two frequencies are equal and even in the case where toner residual quantities are equal in the same phase and in opposite phases, so that accuracy of detection is degraded.

For the above reason, it is not preferable to make the frequencies of two biases the same since there is a need of accurately detecting an electric current value in a configuration, in which a toner residual quantity is detected on the basis of a change in an electric current value induced as in the embodiment.

Even when the frequencies of two biases are equal, however, the above problem is not caused provided that the two biases can be designed to be always applied in the same phase or in opposite phases. In the case where this is impossible, it is not preferable to use the same frequency.

Putting the above together, in the case where there is a need of approximating two frequencies of the charging bias and the developing bias to each other, degradation in accuracy of detection of a developer residual quantity can be suppressed by choosing (1) making the frequencies equal and making sure of their application in the same phase, and (2) not using the same frequency.

(Measures for Simultaneously Preventing a Cyclic Density Unevenness and Degradation in Accuracy of Detection of a Residual Quantity)

In view of the above results, it is preferable not to make frequencies of the charging bias and the developing bias the same value but to make them very close values in order to prevent a cyclic density unevenness and degradation in accuracy of detection of a developer residual quantity when there is caused a need of approximating frequencies of the charging bias and the developing bias to each other.

Also, on the observation of an actual image, it was found that a cycle was not so much noticeable and any serious problem was not caused provided that a cycle of density unevenness was 10 mm or more. Accordingly, it was found that when a frequency Hz1 (Hz) of the charging bias, a frequency Hz2 (Hz) of the developing bias, and the process speed PS (mm/sec) met the following relations, it was possible to suppress cyclic density unevenness and degradation in accuracy of detection of a developer residual quantity.

That is,

10<PS/|Hz1-Hz2| and Hz1≠Hz2 should be satisfied.

(Measures for Avoiding an Undesirable Image and Variation in Output)

The biases in the embodiment are formed by providing a reference clock generating means and dividing a clock frequency. Since both the charging bias and the developing bias are formed on the basis of the same clock for reference, differences of frequencies of the two biases are never shifted.

In the case where frequencies of the two biases are not largely varied by operating conditions or the like, it is not always necessary to use such reference clock.

As described above, it has been found in the embodiment that by setting a charging frequency, a developing frequency, a process speed, and a representative value decision time for deciding a representative value of a toner residual quantity, respectively, in appropriate relationships, there is caused no problem in image and variation in residual quantity detected values can be suppressed.

Accordingly, accuracy in detection of a toner residual quantity is enhanced to thereby enable precisely catching time of exchange of a process cartridge, time of replenishment of toner, or the like. Accordingly, it is possible to prevent generation of bad images such as void images leaving the background white free of toner, and to suppress waste of a resource such as wasting of toner.

With respect to the embodiment, detection of a developer residual quantity in a process cartridge has been described but the same effect can be produced in a configuration of a type, in which a developer is replenished.

Also, the process cartridge illustrated above is formed by integrating at least one of charging means, developing means and cleaning means, and an image bearing member into a cartridge, and made detachable from a body of an image forming apparatus of an electrophotography system.

An alternating component in the charging bias and the developing bias described in the above embodiments may be formed by repeating ON and OFF of a direct current component. Also, it is possible to use sinusoidal wave, rectangular wave, triangular wave, or the like as a waveform of the alternating component.

What is claimed is:

1. An image forming apparatus comprising an image bearing member;

a charging means for charging the image bearing member, to which charging means is applied a charging voltage including a first alternating component; and a developing means for developing an electrostatic image formed on the image bearing member with developer, to which developing means is applied a developing voltage including a second alternating component; and wherein $10<PS/|Hz1-Hz2|$ is satisfied where Hz1 (Hz) indicates a frequency of the first alternating component, Hz2 (Hz) indicates a frequency of the second alternating component, and PS (mm/sec) indicates a peripheral speed of the image bearing member.

2. The image forming apparatus according to claim 1, further comprising a developer residual quantity detecting means for detecting a residual quantity of the developer by the use of the developing voltage.

3. The image forming apparatus according to claim 2, wherein

Ca1_t (sec) satisfies $Ca1_t\times|Hz1-Hz2|>4$ where Ca1_t indicates a decision time for deciding a representative value related to a residual quantity of the developer on the basis of a detected value from the developer residual quantity detecting means.

4. The image forming apparatus according to claim 2, wherein

Ca1_t (sec) satisfies $Ca1_t\times|Hz1-Hz2|=1$ or $Ca1_t\times|Hz1-Hz2|=2$ or $Ca1_t\times|Hz1-Hz2|=3$ or $Ca1_t\times|Hz1-Hz2|=4$ where Ca1_t indicates a decision time for deciding a representative value related to a residual quantity of the developer on the basis of a detected value from the developer residual quantity detecting means.

5. The image forming apparatus according to claim 1, wherein the charging voltage and the developing voltage are formed by dividing clock generated by a common oscillation circuit.

6. The image forming apparatus according to claim 2, wherein the developer residual quantity detecting means comprises a plurality of electrode members and a residual quantity of the developer is determined according to an electrostatic capacity among the plurality of electrode members when the developing voltage is applied.

7. The image forming apparatus according to claim 6, wherein the developing voltage is applied to one of the plurality of electrode members.

8. The image forming apparatus according to claim 1, wherein the charging means is provided in contact with the image bearing member.

9. The image forming apparatus according to claim 1, wherein the image bearing member, the charging means, and the developing means are provided in a process cartridge, which is detachable from a body of the image forming apparatus.

* * * * *

UNITED STATES PATENT AND TRADEMARK OFFICE

CERTIFICATE OF CORRECTION

PATENT NO. : 6,801,724 B2
DATED : October 5, 2004
INVENTOR(S) : Hideki Matsumoto et al.

It is certified that error appears in the above-identified patent and that said Letters Patent is hereby corrected as shown below:

Title page,
Item [57], ABSTRACT,
Line 5, "whereby" should read -- thereby --.

Column 1,
Line 13, "include," should read -- includes, --; and
Line 59, "an" should be deleted.

Column 3,
Line 15, "object and feature" should read -- objects and features --; and
Lines 20, 23 and 26, "cross sectional" should read -- cross-sectional --.

Column 4,
Lines 12 and 41, "cross sectional" should read -- cross-sectional --.

Column 5,
Line 13, "Care" should read -- C are --.

Column 8,
Line 18, "show" should read -- shown --.

Column 13,
Line 23, "comprising" should read -- comprising: --.

Signed and Sealed this

First Day of February, 2005

JON W. DUDAS
*Director of the United States Patent and Trademark Office*